US005700293A

United States Patent [19]

Rydell

[11] Patent Number: 5,700,293

[45] **Date of Patent: *Dec. 23, 1997**

[54] LAUNDRY SORTING AND STORAGE DEVICE AND METHOD

[76] Inventor: Susan M. Rydell, 8062 Charlecot Dr., Indianapolis, Ind. 46268

[ * ] Notice: The term of this patent shall not extend beyond the expiration date of Pat. No. 5,228,760.

[21] Appl. No.: 685,171

[22] Filed: Jul. 23, 1996

Related U.S. Application Data

[62] Division of Ser. No. 61,351, May 13, 1993, Pat. No. 5,547,271.

[51] Int. Cl.[6] ..... A47B 81/00; D06F 93/00; D06F 95/00

[52] U.S. Cl. ..... 8/137; 232/1 R; 232/1 B; 312/245; 312/211

[58] Field of Search ..... 8/137; 232/1 R, 232/1 B; 220/334; 312/246, 211, 245; 68/210, 13 R, 235 R, 240

[56] References Cited

U.S. PATENT DOCUMENTS

| | | | |
|---|---|---|---|
| D. 144,792 | 5/1946 | Kohen . | |
| D. 195,279 | 5/1963 | Taylor . | |
| 1,650,824 | 11/1927 | Eagles . | |
| 2,625,973 | 1/1953 | Weldon . | |
| 2,726,913 | 12/1955 | Freeman . | |
| 2,736,454 | 2/1956 | McConnell . | |
| 2,895,782 | 7/1959 | Fragale . | |
| 3,958,715 | 5/1976 | Capelli . | |
| 3,995,924 | 12/1976 | Jones . | |
| 4,057,309 | 11/1977 | Fragale . | |
| 4,195,498 | 4/1980 | Pellerin | 68/3 R |
| 5,228,760 | 7/1993 | Rydell | 312/211 |
| 5,547,271 | 8/1996 | Rydell | 312/211 |

FOREIGN PATENT DOCUMENTS 28529 12/1956 Finland .

*Primary Examiner*—Alan Diamond

*Attorney, Agent, or Firm*—Woodard, Emhardt, Naughton, Moriarty & McNett

[57] ABSTRACT

A method and device for storing and sorting laundry is disclosed comprising one or more elevated laundry bins each with a top end opening and a normally-closed drop bottom. The bins are elevated above a laundry work area so that laundry contained within each bin is released to the laundry work area upon opening the drop bottom. One or more laundry bins can be combined adjacent to each other to form a multiple bin unit which sorts laundry by receiving laundry within the separate laundry bins. The method includes storing the laundry until the volume of a bin is filled whereupon it is released to a laundry machine having a load volume equal to the bin volume.

5 Claims, 5 Drawing Sheets

LAUNDRY SORTING AND STORAGE DEVICE AND METHOD

This application is a division of application Ser. No. 08/061,351, filed May 13, 1993, now U.S. Pat. No. 5,547,271.

BACKGROUND OF THE INVENTION

The present invention relates in general to a method and device for sorting, storing, and laundering laundry.

Household duties in the past have been the focus of a variety of devices which reduce both the amount of time spent and effort expended to complete a particular household chore. Among other household duties which have to be performed on a routine basis such as cooking and cleaning, laundering today still presents one of the most time intensive duties. Although laundry machines, including washing and drying machines, have been developed which reduce the effort expended and ease the chore of laundering, little attention has been paid to the reduction of the time spent in laundering. As our society struggles to increase its productivity and compete more favorably in the world economy, disposable time becomes more sparse and increasingly valuable. The capability, therefore, to reduce or eliminate the time associated with routine household chores has become a household priority.

For example, each week a typical household, after accumulating soiled garments in hampers during the week, does a minimum of four loads of laundry. A typical laundry chore requires collecting dirty laundry, stored in several locations throughout a household, into a central location. Upon collection, the laundry is then sorted, typically on the floor, by type and quantity into individual loads of laundry. The individual loads are then washed, dried, folded and returned to either closets or drawers, the overall time involved usually spanning a minimum of seven hours, or typically an entire working day.

Several problem areas can be identified with the current method for laundering, including the storage of clothes, the sorting of clothes and the actual washing and drying of clothes. First, current storage methods for laundry are inefficient because an individual cannot easily wash a full, sorted load of laundry without first accumulating all laundry from all stored locations. Hampers or laundry baskets used to collect dirty garments are often unsightly, overflowing and odorous. Random storage prevents location of a particular item and determination of whether a full load of one type of laundry has accumulated. Furthermore, transporting several full hampers or baskets of clothes to a central location, especially in a multi-level house where climbing stairs is required, is not only time-consuming but laborious as well. Similarly, the repetitive bending and lifting required of the launderer by current laundry storage devices is laborious and possibly dangerous, as improper lifting can lead to chronic back injuries.

Current storage methods are also inefficient because sorting is a time consuming procedure required before laundry can be processed. Unsorted accumulation of soiled laundry in several storage locations precludes doing a single sorted load quickly because all laundry in all stored locations must be sorted first to determine if a full load has accumulated. Also, if several partial loads result upon sorting of laundry, the launderer must either run the inefficient smaller loads or return the sorted partial loads of clothes back to their stored locations to be resorted during the next laundry cycle. Furthermore, the sorting of clothes by type is dependent on the individual preferences of the launderer. Many individuals do not let other persons or businesses do their laundry simply because of the possibility that the laundry will be incorrectly sorted and clothing will be ruined.

Finally, the inability to have quick access to single, sorted loads of clothes results in the launderer having to sort and wash four or more loads consecutively. Although laundering a single load of clothes does not require extensive time, effort and expertise, the chore of washing several loads consecutively forces the launderer to be paced by the machine cycles of the laundry machinery. For example, the time involved in laundering a single load of laundry with typical laundry machinery requires 25 minutes for the washing machine cycle and 100 minutes for the drying machine cycle. As most households employ only a single washer and dryer, laundering four loads of laundry will require 425 minutes or over 7 hours (one washing cycle plus four drying cycles, the remaining washing cycles occurring during the drying cycles).

Past devices which have attempted to either store clothing or sort clothing are similar to current laundry hampers in that laundry is stored at ground level. For example Eagles, U.S. Pat. No. 1,650,824, presents a laundry clothes holder having compartments and wheels for easy transportation of laundry. Weldon et al., U.S. Pat. No. 2,625,973, shows a laundry hamper having separate compartments covered by a lid. Upon opening the lid, legends are presented that set forth the particular type of laundry for each compartment. McConnell, U.S. Pat. No. 2,736,454, describes a compartmentalized clothes hamper having a lid which is foot actuated. Fragale, U.S. Pat. No. 2,895,782, presents a clothes hamper having doors and a lid, the lid upon opening presenting indicia plates.

Jones, U.S. Pat. No. 3,995,924, depicts an apparatus for sorting clothes. The apparatus is compartmentalized, with the compartments being removable. Fragale, U.S. Pat. No. 4,057,309, discloses a clothes hamper which is compartmentalized and which has a drawer that is also compartmentalized. Capelli, U.S. Pat. No. 3,958,715, discloses a partitioned ventilated clothes hamper, the partition also being ventilated to allow circulation of air within the hamper. Kohen, Pat. No. Design 144,792, shows a clothes hamper with what appears to be shelving affixed to one side. Lastly, a Wall Hung Clothes Hamper or Similar Article is depicted in Pat. No. Design 195,279 by Taylor.

A need therefore exists for an improved laundry storage device. A need also exists for an improved laundry storage device which also minimizes the effort required to accumulate sorted laundry, including reducing the bending and lifting of accumulated laundry. Also desired is an improved laundry storage device which also stores and sorts accumulated soiled laundry without allowing odors to accumulate.

SUMMARY OF THE INVENTION

According to one embodiment of the present invention a laundry system is disclosed, comprising a laundry machine for processing laundry, an elevated laundry bin including a top end opening and a normally-closed drop bottom, and means for mounting the elevated laundry bin at a height above the laundry machine with the normally-closed drop bottom aligned over the laundry machine, wherein the elevated laundry bin receives laundry through the top end opening, the laundry being contained by the elevated laundry bin when the normally-closed drop bottom is closed, and wherein the normally-closed drop bottom opens downwardly to release the laundry from the elevated laundry bin, whereupon release laundry falls from the elevated laundry bin to the laundry machine.

Another embodiment of the present invention includes a laundry system, comprising a laundry work area for processing laundry, an elevated laundry bin including a front element, a rear element, first and second side elements connected between the front element and the rear element, the first and second side elements, the front element and the rear element defining a top end opening, and a bottom element connected to the rear element between the first and second side elements, the first and second side elements, the front element and the bottom element defining a bottom end opening remote from the rear element, and means for mounting the elevated laundry bin at a height above the laundry work area with the normally-closed drop bottom aligned over the laundry work area, wherein the elevated laundry bin receives laundry through the top end opening, the laundry being contained by the elevated laundry bin when the normally-closed drop bottom is closed, and wherein the normally-closed drop bottom opens downwardly to release the laundry from the elevated laundry bin, whereupon release laundry falls from the elevated laundry bin to the laundry work area.

Still another embodiment of the present invention includes a method for laundering laundry, comprising the steps of mounting an elevated laundry bin having a top end opening and a normally-closed drop bottom at a height above a laundry machine with the normally-closed drop bottom aligned over the laundry machine, placing laundry through the top end opening in the elevated laundry bin until the elevated laundry bin is full, the laundry being contained by the elevated laundry bin when the normally-closed drop bottom is closed, and emptying laundry from the elevated laundry bin to the laundry machine by releasing open the normally-closed drop bottom, whereupon release the laundry falls from the elevated laundry bin to the laundry machine.

A general object of the present invention is to provide an improved laundry sorting and storage device.

Another object of the present invention is to provide an improved laundry sorting and storage device which also minimizes the effort required to accumulate laundry, including reducing the bending and lifting of accumulated laundry.

Another object of the present invention is to provide an improved laundry sorting and storage device which also sorts and stores accumulated soiled laundry.

These and other objects, features and advantages of the present invention will become more apparent from the following written description of the preferred embodiments and the accompanying figures.

DESCRIPTION OF THE PREFERRED EMBODIMENT

Figure 1:
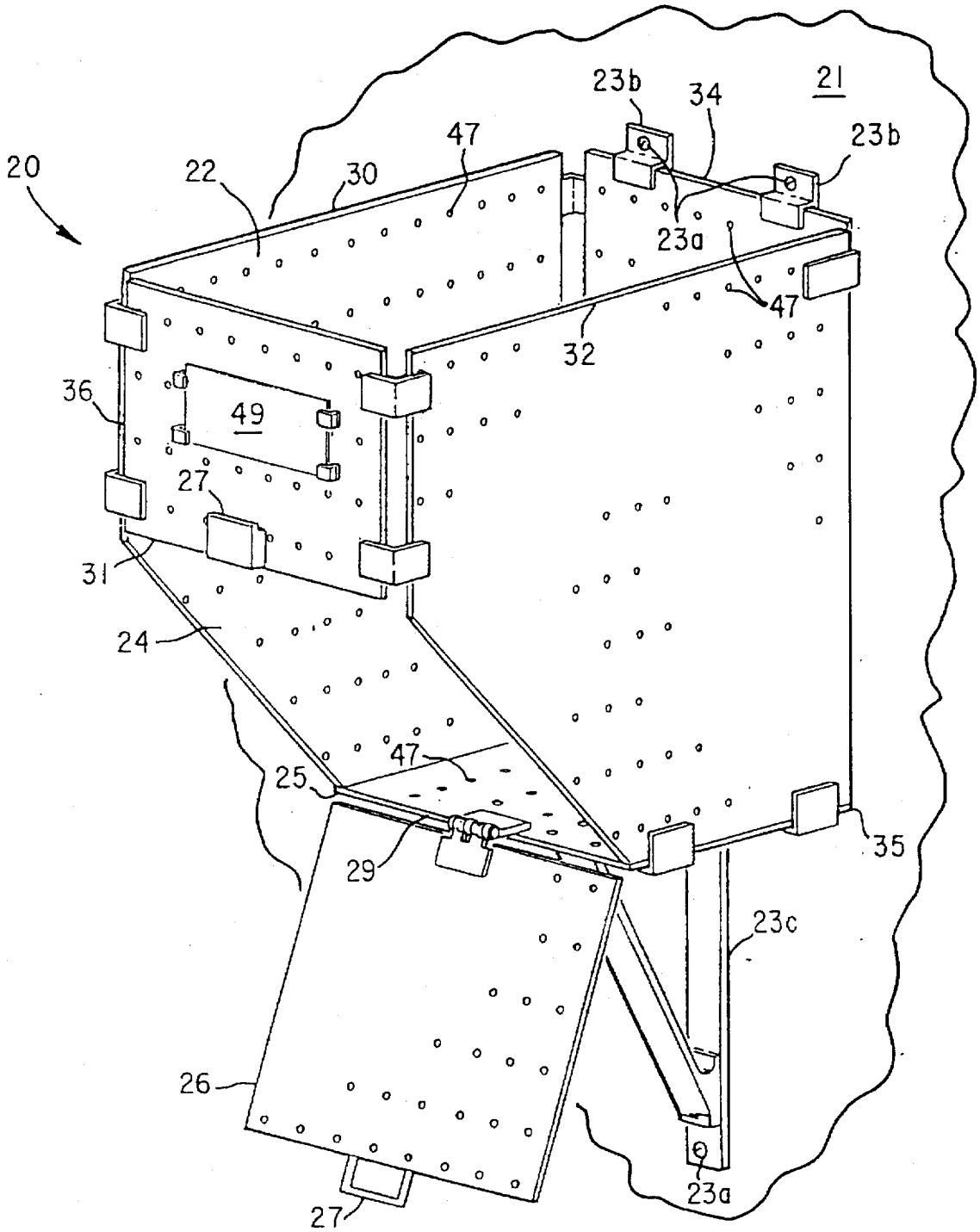
FIG. 1 is a side perspective view of one embodiment of a laundry sorting and storage device according to the present invention depicting a drop bottom in an open position.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now to FIG. 1, a laundry bin 20 according to the present invention is shown having a top end opening 22 and a bottom end opening 24. Also shown is a drop bottom 26 in an open position. Drop bottom 26 is normally-closed; that is, covering bottom end opening 24. Drop bottom 26 fastens in its closed position by clasp 27. When drop bottom 26 is fastened closed, laundry bin 20 contains laundry via sides 30 and 32, rear 34, front 36, and bottom 25 and drop bottom 26. Laundry bin 20 receives laundry through top end opening 22 and contains the laundry therein until clasp 27 is unfastened and drop bottom 26 is opened. Drop bottom 26 is hinged about bottom edge 29, and when unfastened, drop bottom 26 swings downward under its own weight and under the weight of the laundry contained within laundry bin 20. Upon drop bottom 26 opening downward, laundry is released from bin 20 and falls through bottom opening 24.

Drop bottom 26 is also contemplated being hinged about front edge 31 with fastening occurring across edge 29. Similarly, drop bottom 26 can also comprise bottom 25 via an articulating joint at bottom edge 29, with bottom 25 and drop bottom 26 hinging about bottom edge 35 and fastening across front edge 31. Laundry bin 20 would still contain laundry as previously discussed, however upon unfastening clasp 27, both bottom 25 and drop bottom 26 would swing downward about bottom edge 35. Laundry bin 20 is also shown with drop bottom 26 at an angle relative to vertical to facilitate installation and usage as discussed in conjunction with FIG. 3. Similarly, laundry bin 20 is also shown having labels 49 for displaying information and holes 47 for ventilation as discussed in conjunction with FIG. 2.

Laundry bin 20 can employ a variety of construction techniques and materials to contain laundry. The material chosen is, among other considerations, a function of weight requirements. Because bin 20 can be mounted against an interior wall, a lightweight material is preferable to minimize both reinforcement of the wall and the number of anchoring locations required to mount bin 20. Possible materials include plastic or vinyl coated steel wire grids and formed plastics or wood, including laminates and pressed wood composites. Similarly, laundry bin 20 can be constructed having a wire frame with canvas looped over and attached around the wire frame, the wire frame supporting the laundry via the canvas.

Another consideration in choosing a material is the ability of the material to allow for air circulation or breathing to prevent unwanted accumulation of odors. Plastic or vinyl coated steel wire grids and canvas directly facilitate ventilation. Other more dense plastics and woods, however, should have additional holes incorporated to both reduce their weight and provide for circulation of air.

Another consideration in choosing a material is the material's ability to withstand degradation, including peeling, splintering or fading. Degradation can result in damage to clothing, such as tearing, pilling or staining of the clothes.

Laundry bin 20 is constructed having a size or volume which approximates that of a typical load of laundry received by a washing machine. Although a variety of shapes and dimensions for laundry bin 20 can achieve a desired common volume, laundry bin 20 is constructed having generally dimensions of 12 inches wide by 18 inches tall by 20 inches deep. Of course, these dimensions are but one of many possible sets of dimensions which meet the desired volume to contain a load of laundry while still providing a light weight structure and convenience in use.

Laundry bin 20 is shown in FIG. 1 elevated above ground or floor level and attached to wall 21. Attachment to wall 21 is provided by a combination of fasteners 23*a* and brackets 23*b* and 23*c* which both support and anchor laundry bin 20 to wall 21. These fasteners and brackets are typical of those used with drywall, as is the case with many interior walls of a house. Laundry bin 20 does not necessarily require attachment to a fixed surface such as a wall or above laundry machinery. For example, laundry bin 20 can also be attached to a wheeled frame which allows transportation of laundry bin 20 while still providing elevation of bin 20. Other means for mounting a laundry bin such as bin 20 above a laundry machine are described further hereinafter in connection with FIGS. 5 and 6. Whatever attaching means are employed, laundry bin 20 should be elevated above ground level, thereby reducing bending and lifting of laundry.

Figure 2:
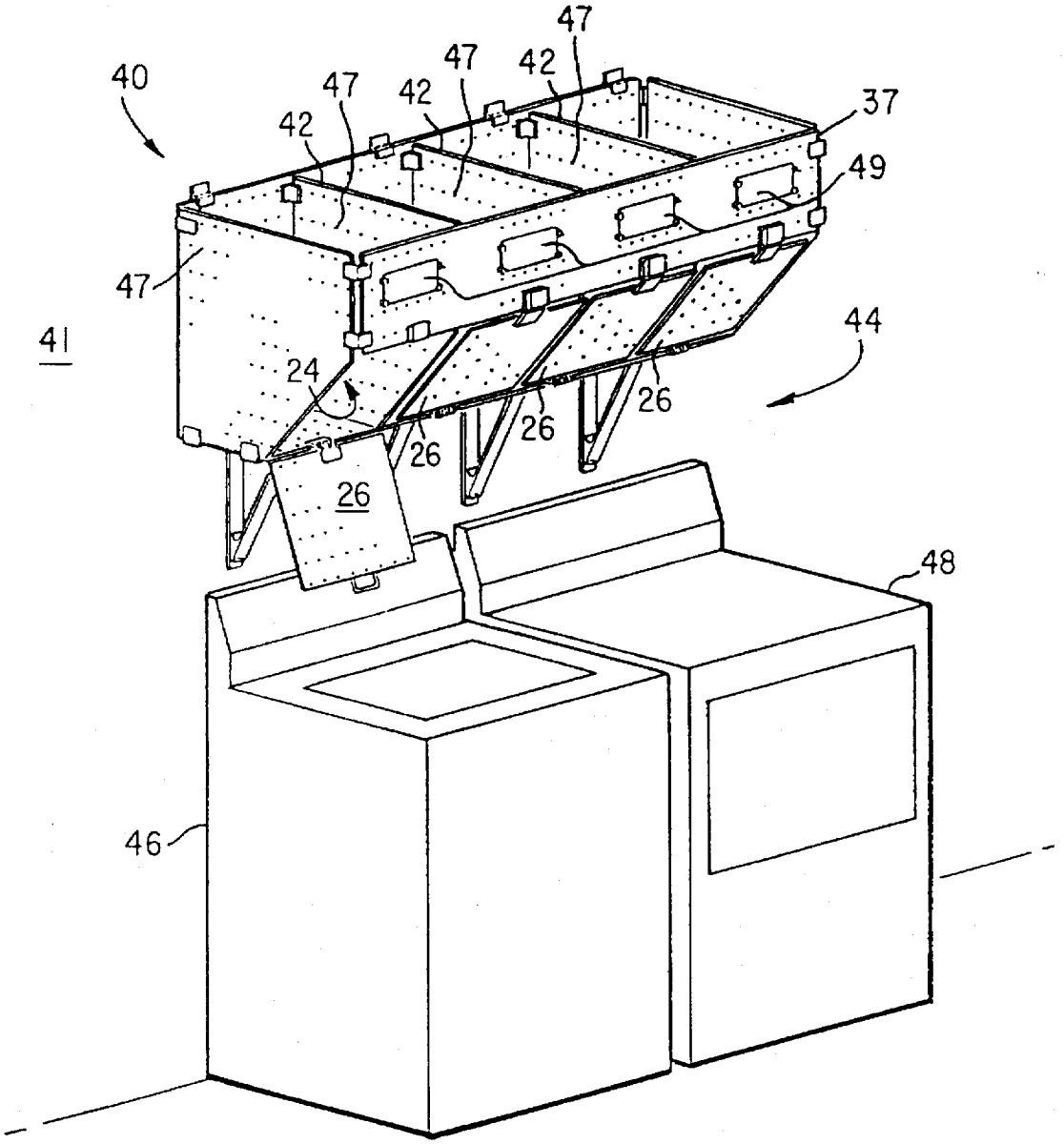
FIG. 2 is a front perspective view of another embodiment of a laundry sorting and storage device according to the present invention mounted on a wall and over laundry machinery.

Referring now to FIG. 2, a laundry bin unit 40 is shown as a preferred embodiment of the present invention. Unit 40 comprises four laundry bins adjacent to each other and sharing common sides 42. Sides 42 are in essence dividers which separate unit 40 into individual compartments. Unit 40 is shown in a typical environment mounted against wall 41 at an elevation above working area 44. Working area 44 can comprise a table for receiving laundry upon drop bottom 26 opening, or as shown, can include laundry machinery such as washing machine 46 and drying machine 48. Unit 40 is constructed from Masonite™, a fiberboard having holes 47 incorporated for both ventilation external to and within unit 40.

Unit 40 also displays on front panel 37 labels 49. Labels 49 are instruction cards which describe what each bin contains. These descriptions include whites, permanent press, sheets and towels, hand washables, baby clothes, darks, and athletic clothes. Labels 49 can also describe washing instructions associated with the different types of clothing, the washing instructions including washing machine settings for water temperature and length of machine cycles for wash and rinse. Labels 49 can also describe the amount of detergent to be used in the washing machine, whether to add bleach and the amount of bleach to be used, washing machine settings such as regular cycle or double rinse, and drying machine settings such as length of drying cycle and temperature of drying cycle.

Figure 3:
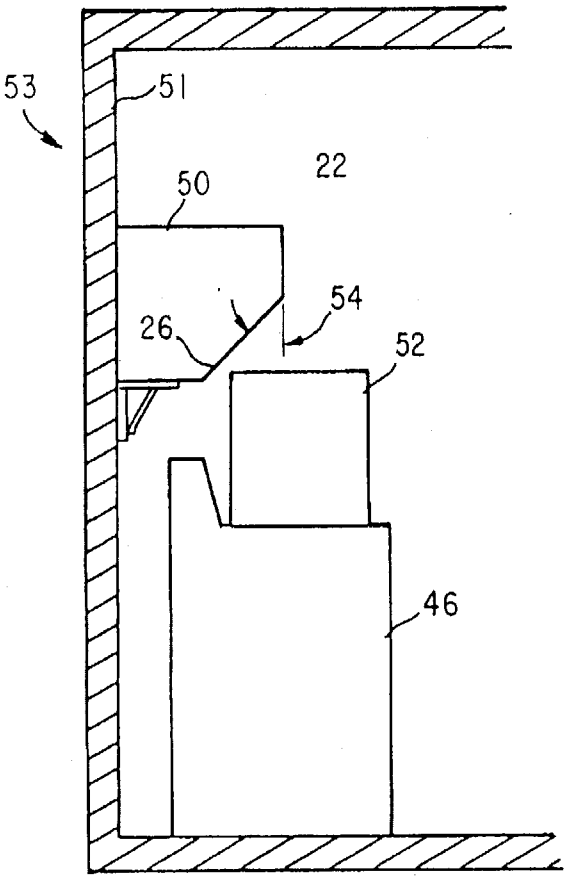
FIG. 3 is a side elevational view of another embodiment of a laundry sorting and storage device according to the present invention mounted on a back wall of a laundry closet.

Referring now to FIG. 3, a laundry bin unit 50 is shown mounted on back wall 51 of closet 53. Unit 50 incorporates drop bottom 26 at an angle 54. Angle 54 is determined by the height of lid 52 of washing machine 46 when the lid is fully extended. Angle 54 provides clearance for lid 52 when open without increasing the height at which unit 50 is mounted to wall 51. Without angle 54, laundry unit 50 would require additional mounting height to clear lid 52. If laundry unit 50 is mounted too high, it will be difficult for a launderer to reach top end openings 22. Angle 54 is 45° relative to vertical, but can also include a range from 30° to 60° relative to vertical, depending on the particular installation. Note that the embodiment of FIG. 2 has the same angle permitting clearance of the laundry machine lid.

Figure 4:
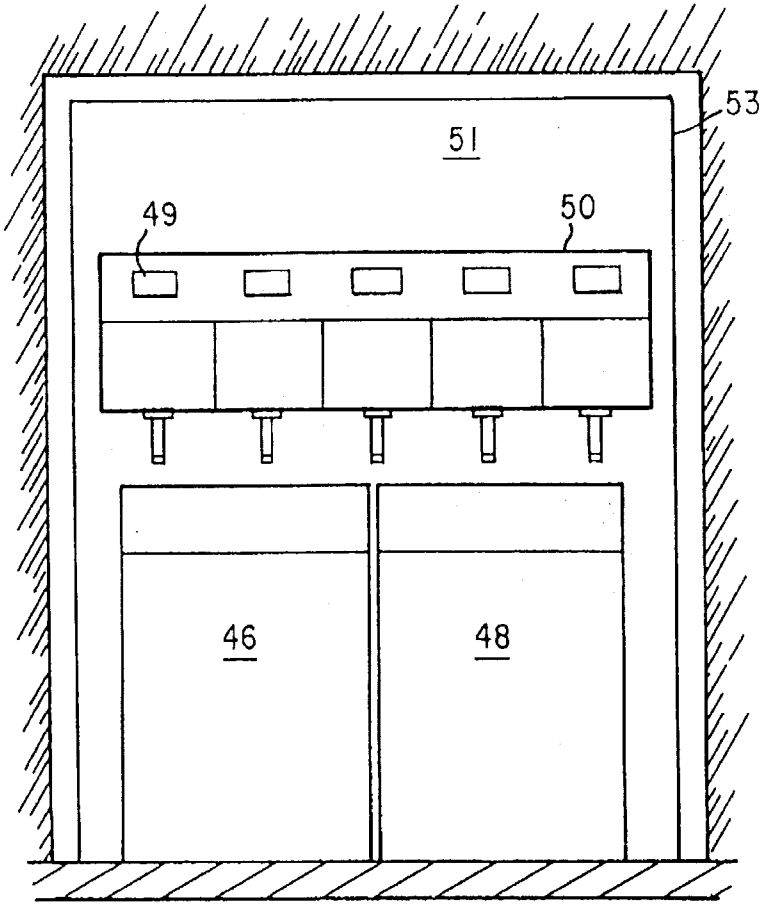
FIG. 4 is a front elevational view of the embodiment shown in FIG. 3 mounted on the back wall of the laundry closet.

Referring now to FIG. 4, unit 50 is shown having five bins or compartments stretching across closet 53. The five bins, when sized for a load of laundry, approximate the length of a typical washing machine and drying machine installation. Unit 50 can be designed having both fewer and greater numbers of compartments; for example, if closet 53 is sized so that it can contain only a washing machine 46, unit 50 would have two bins or compartments.

Finally, laundry bin units 40 and 50 can be used in conjunction with other laundry accessories to make working area 44 more efficient, one example being units 40 and 50 used in conjunction with a shelf. The shelf can be either mounted below or adjacent to the unit 50. Similarly, clothes rods or other handling devices for clothes can be mounted either below or adjacent to the unit depending upon the space available. Also contemplated are embodiments which employ lids for covering the top end opening.

Figure 5:
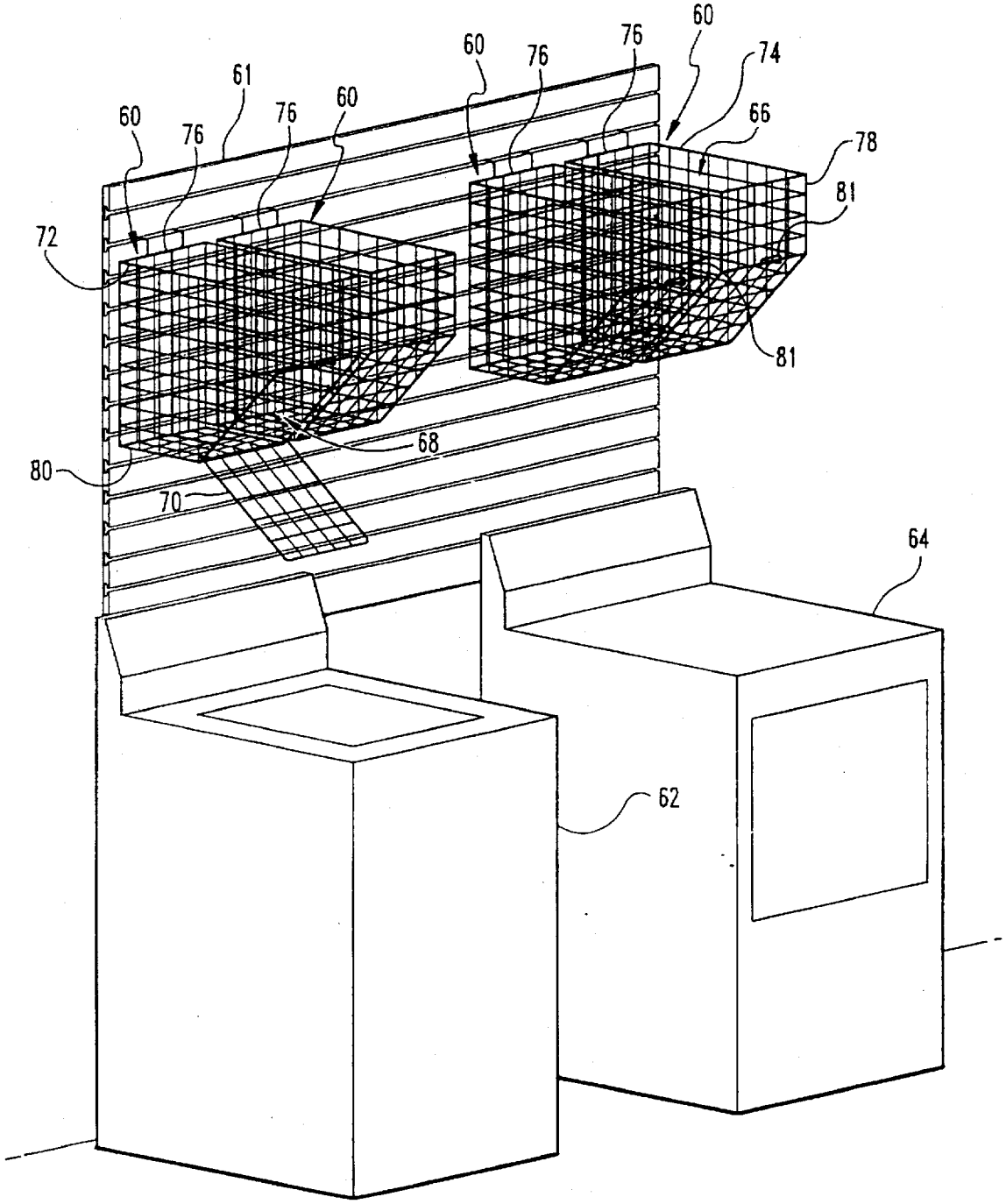
FIG. 5 is a perspective view of yet another embodiment of a laundry sorting and storage device according to the present invention mounted to a slatted wall board over laundry machinery.
Figure 6:
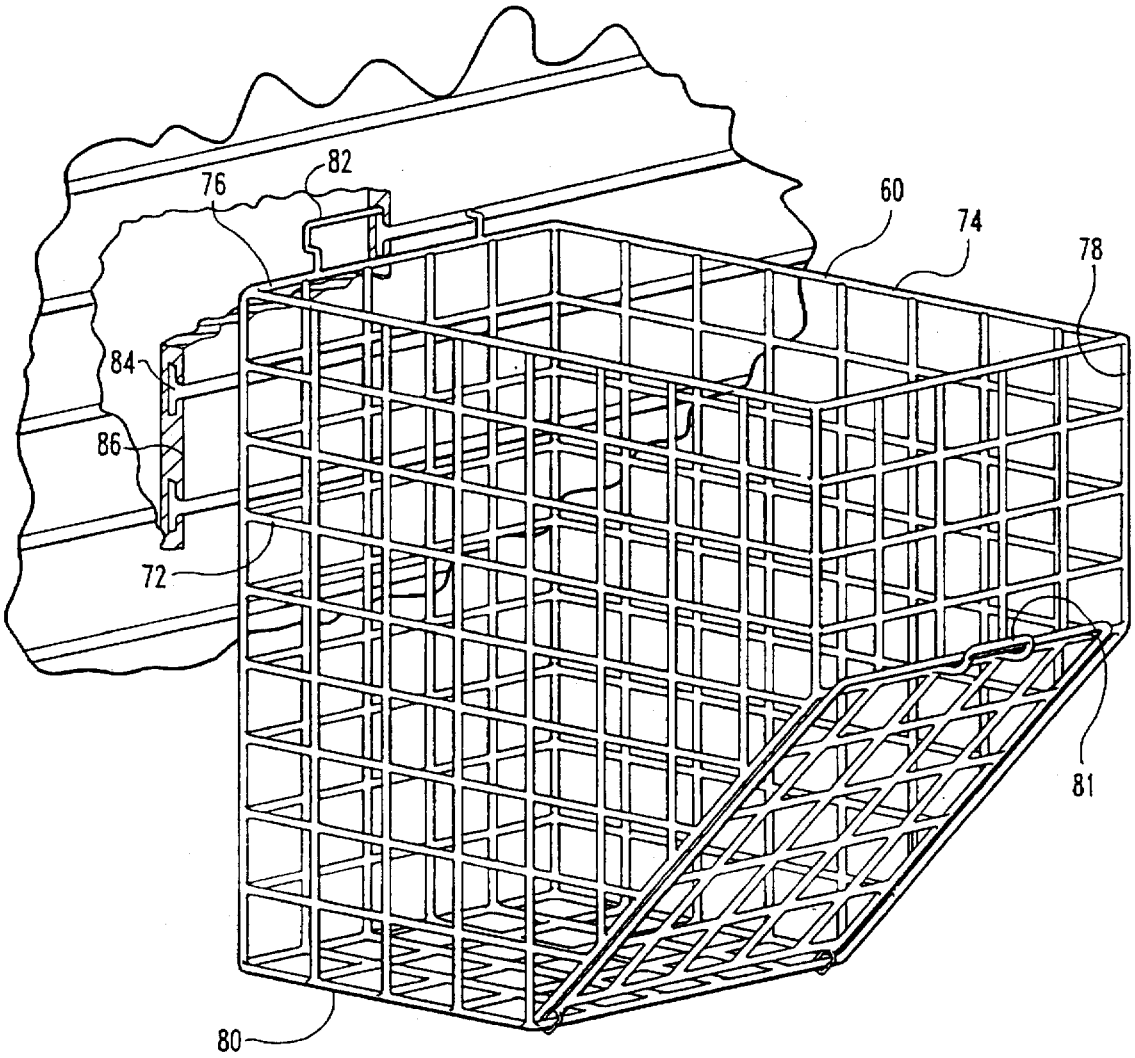
FIG. 6 is a side perspective, partial cross-sectional view of the mounting arrangement of the laundry sorting and storage device of FIG. 5.

Referring now to FIGS. 5–6, other laundry bins and bin mounting arrangements are depicted for use mounted above a laundry work area that includes laundry machines. In FIG. 5, individual laundry bins 60 are mounted in pairs to a slatted wall board 61 above a washing machine 62 and drying machine 64. Bins 60 are mounted individually adjacent one another rather than as a multiple bin unit in this embodiment since washing machine 62 is spaced apart from drying machine 64, such as by a utility sink. Similar to bin 20, each of bins 60 include a top end opening 66 and a bottom end opening 68 closable by a normally-closed drop bottom 70. When drop bottom 70 is fastened closed, laundry bin 60 contains laundry via side panels 72 and 74, rear panel 76, front panel 78, and bottom panel 80. Drop bottom 70 fastens in its closed position by a simple clip 81. Bins 60 are constructed of a 3/16 inch steel wire frame having 1/8 inch steel wire panels. The wire frame and panels are painted to protect against corrosion and to provide an aesthetically pleasing finish.

In FIG. 6, the means for mounting bin 60 to slatted wall board 61 is shown in greater detail. Each of bins 60 includes a generally L-shaped hanging member 82 attached to rear panel 76. Wall board 61 includes generally T-shaped grooves 84 extending horizontally across the wall board and formed by corresponding horizontal T-shaped slats 86. Hanging member 82 is slidably received in grooves 84 and restrained in place supported by slats 86. As such, bins 60 are adjustable lengthwise along grooves 84 while still being supported by wall board 61. Grooves 84 can include vinyl inserts and the like to reduce friction, as well as aluminum inserts for added reinforcement. In one specific embodiment, wall board 61 is constructed of UNICUT™ Red Oak Slotwall available from Melvin L. Cunningham Inc., 6550 Guion Road, Indianapolis, Ind. 46268. Also contemplated are other laundry devices having similar L-shaped hanging members for receipt in grooves 84 supported by wall board 61. For example, hanger rods, towel racks and simple open bins may be supported by wall board 61 adjacent to both bins 60 and laundry machines 62 and 64.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A method for preparing laundry for laundering comprising:

mounting a laundry bin to a wall adjacent to a washing machine, said laundry bin having a rear mounting surface for attachment to the wall, a top end opening and a normally-closed drop bottom positioned above said washing machine when said bin is mounted to said wall, wherein said drop bottom is remote from said rear mounting surface;

collecting laundry periodically in said bin through said top end opening until said bin is full; and emptying laundry from said bin to said washing machine by opening said drop bottom.

2. The method of claim 1 wherein said laundry bin has a laundry volume corresponding to a load of said washing machine.

3. A method for preparing laundry for laundering comprising:

mounting a laundry bin unit to a wall adjacent to a laundry working area, said bin unit having two or more laundry bins adjacent to each other, each bin having a rear mounting surface for attachment to the wall, a top end opening and a normally-closed drop bottom positioned above said laundry working area when said bin is mounted to said wall, wherein said drop bottom is remote from said rear mounting surface;

collecting different types of laundry periodically in said bins until a bin is full by receiving said laundry through said top end openings so that said laundry types are separately contained within said bins when said drop bottoms are closed; and emptying laundry from a full bin to said working area by opening said drop bottom.

4. The method of claim 3 and further comprising the following step:

operating laundry machinery to launder said laundry, said laundry working area including said laundry machinery.

5. The method of claim 4 wherein said laundry machinery comprises a washing machine, each of said laundry bins having a laundry volume corresponding to a load of said washing machine.

* * * * *